US010109969B2

(12) United States Patent
Faber et al.

(10) Patent No.: US 10,109,969 B2
(45) Date of Patent: Oct. 23, 2018

(54) DEVICE DISCHARGING GROUND CURRENTS, PARTICULARLY IN WIND TURBINES

(71) Applicant: PANTRAC GMBH, Berlin (DE)

(72) Inventors: Manfred Faber, Bedburg (DE); Bernd Kinast, Berlin (DE); Wolfgang Vesper, Bonn (DE); Dirk Wolter, Bonn (DE)

(73) Assignee: PANTRAC GMBH, Berlin (DE)

( * ) Notice: Subject to any disclaimer, the term of this patent is extended or adjusted under 35 U.S.C. 154(b) by 386 days.

(21) Appl. No.: 14/897,902

(22) PCT Filed: Jun. 25, 2014

(86) PCT No.: PCT/EP2014/063414

§ 371 (c)(1),
(2) Date: Dec. 11, 2015

(87) PCT Pub. No.: WO2014/207047

PCT Pub. Date: Dec. 31, 2014

(65) Prior Publication Data

US 2016/0134072 A1 May 12, 2016

(30) Foreign Application Priority Data

Jun. 25, 2013 (DE) ..... 10 2013 212 062

(51) Int. Cl.
*H01R 39/20* (2006.01)
*H01R 39/26* (2006.01)

(52) U.S. Cl.
CPC ..... *H01R 39/26* (2013.01); *H01R 39/20* (2013.01)

(58) Field of Classification Search
CPC ..... H02K 13/10; H01R 39/20; H01R 39/26
See application file for complete search history.

(56) References Cited

U.S. PATENT DOCUMENTS 2,640,944 A * 6/1953 Ramadanoff ..... H01R 39/20 252/503
2,989,490 A * 6/1961 Ramadanoff ..... H01B 1/00 252/503

(Continued)

FOREIGN PATENT DOCUMENTS

CN 1 701 487 A 11/2005
DE 4403433 A1 8/1995

(Continued)

OTHER PUBLICATIONS

International Search Report dated Sep. 8, 2014, dated Dec. 9, 2014.

(Continued)

*Primary Examiner* — Dang Le
(74) *Attorney, Agent, or Firm* — Norris McLaughlin P.A.

(57) ABSTRACT

Devices for discharging ground currents, more particularly in wind turbines, from electrical machines. The devices have a grounding ring mounted on a rotor of the electrical machine and a sliding contact connectable to ground and that is in contact with the grounding ring. The sliding contact element has a carbon brush with a bulk density between 1.1 and 1.4 g/cm$^3$, and the carbon brush contains a metal inclusions composed of silver, the silver proportion being between 1 and 8%.

2 Claims, 1 Drawing Sheet

(56) References Cited

U.S. PATENT DOCUMENTS

| | | | | |
|---|---|---|---|---|
| 3,284,371 | A | 11/1966 | Krellner | |
| 4,799,957 | A * | 1/1989 | Vogel | B60L 5/205 252/502 |
| 5,634,800 | A | 6/1997 | Giamati | |
| 2008/0303373 | A1* | 12/2008 | Namikoshi | H01R 39/20 310/253 |
| 2012/0326081 | A1 | 12/2012 | Kagawa et al. | |
| 2017/0047697 | A1* | 2/2017 | Kagawa | H01R 39/26 |

FOREIGN PATENT DOCUMENTS

| | | | |
|---|---|---|---|
| DE | 10 2010 039065 | A1 | 2/2012 |
| EP | 0 212 666 | A2 | 3/1987 |
| EP | 1 662 640 | A1 | 5/2006 |
| GB | 804688 | A | 11/1958 |
| WO | 2007/073793 | A1 | 7/2007 |

OTHER PUBLICATIONS

English Translation of International Search Report dated Sep. 8, 2014, dated Dec. 9, 2014.

* cited by examiner

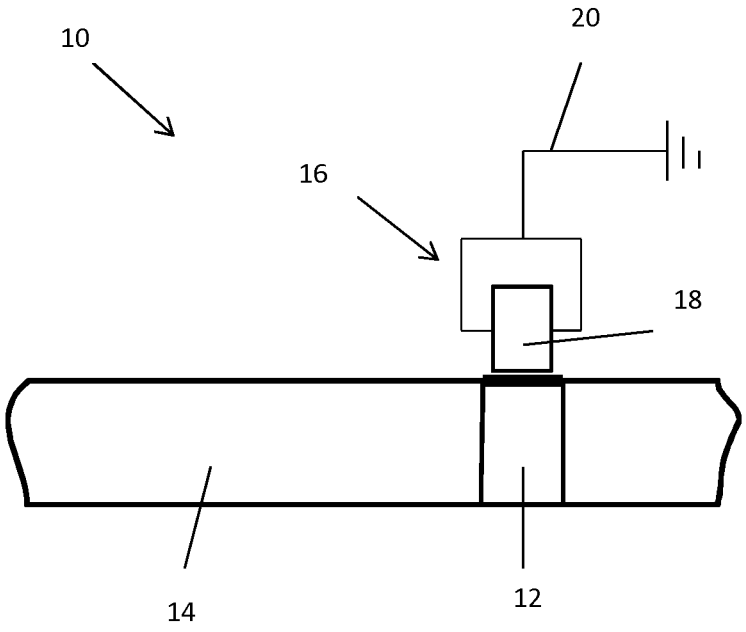
10
20
16
18
14
12

DEVICE DISCHARGING GROUND CURRENTS, PARTICULARLY IN WIND TURBINES

This application is the U.S. National Stage of International Application No. PCT/EP2014/063414, filed Jun. 25, 2014, which claims foreign priority benefit under 35 U.S.C. § 119 of German application 10 2013 212 062.1 filed Jun. 25, 2013.

The invention relates to a device for discharging ground currents, particularly in wind turbines, from electrical equipment, with a grounding ring arranged on a rotor of the electric machine and a sliding contact element connected to ground and in contact with the grounding ring.

Devices of the generic type are known in the art.

Shaft voltages are produced in large electrical machines in the grid operation and in electrical machines in converter operation. Once these shaft voltages exceed a certain threshold in the range of approximately 4 V (peak voltage), electrical breakdown occurs in the hydrodynamic, a few pm thick, insulating oil film of the bearings. This electrical breakdown damages the running surfaces and causes electrical erosion, which can significantly reduce the static bearing lifetime.

In converter machines, shaft voltages are also caused by the so-called common mode voltage. In contrast to the three-phase system, the voltage vectors of the three phases at the inverter output do not always cancel out to zero. This technology-related residual voltage is referred to as Common Mode Voltage. By way of a resonant circuit composed of the wiring inductance and the machine capacitance, the pulses of the common mode voltage induce shaft voltages in the form of strongly damped electrical oscillations. The frequencies of these oscillations are in the range of 30 to 50 kHz and the repetition frequencies of the individual voltage peaks correspond to the converter switching frequency which is in the range of 2 to 3 kHz.

In rotor-fed wind power asynchronous generators, the converter is connected directly to the rotor via slip rings.

To discharge the bearing currents, i.e. to not conduct them via the bearing, so-called shaft grounding is disclosed in DE 10 2010 039 065 A1. Here, a grounding ring is arranged on the shaft, which is in contact with a sliding contact element that is connected to ground. The sliding contact element is, as is known in the art, formed by a metal-graphite brush or a layered metal-graphite/natural-graphite brush.

It has been found that the device for discharging ground currents exhibits relatively rapid wear when the metal-graphite brushes or layered metal-graphite/natural-graphite brushes are used. Blotches as well as burns and metal deposits occur regularly on the grounding rings and the contact tracks. Micro-arcing occurs between the grounding ring and the sliding contact element, causing erosion of the grounding ring. The accompanying mechanical wear of the grounding rings and of the sliding contact elements in contact therewith causes an increase of the voltage drop across the contact partners. As a result, there is a risk that the ground currents are not discharged via the device for discharging ground currents, but instead via the bearing, which are then subject to wear that could in principle be prevented.

It is therefore an object of the invention to provide a device of the generic type for discharging ground currents, which is distinguished by a simple construction and wear resistance, and which furthermore safely discharges high-frequency currents.

According to the invention, this object is attained with a device having the features recited in claim 1 The sliding contact element has a carbon brush with a bulk density from 1.1 to 1.4 g/cm3, and the carbon brush has a metal incorporation of silver, wherein the silver proportion is between 1 and 8%. The brush can then exhibit high elasticity. With this low bulk density, compared to conventional metal graphite brushes, the carbon with metal inclusions ensures good electrical and mechanical contact between the sliding contact element and the grounding ring, accompanied by high long-term stability with very constant friction coefficients over the entire load range. The coefficient of friction is, for example, in the range between 0.15 and 0.20. The coefficient of friction remains constant under different operating and environmental conditions.

Wear of the grounding ring, i.e. the contact path coming into contact with the sliding contact, is reduced to an absolute minimum.

Due to the addition of silver, a uniform and low voltage drop is attained for different operating and environmental conditions. The carbon with metal inclusions having the bulk density according to the invention also exhibits the aforedescribed advantages. With the inventive combination of graphite having a low density and a constant, high coefficient of friction with a low silver content in the matrix, the elasticity and the coefficient of friction of the graphite material is preserved, with the small amount of silver only slightly affecting the density while at the same time significantly reducing voltage peaks. High-frequency currents can thus be safely discharged of from the shaft. The bearings are thus safely protected and hence have a long static lifetime.

Overall, the maintenance interval for monitoring or exchanging the sliding contact element and/or the grounding ring can be significantly extended. In particular, a clear economic advantage is achieved in particular when using rotor-fed asynchronous generators in wind turbines because of the frequently difficult access, for example, in offshore applications.

In a preferred embodiment of the invention, the bulk density of the carbon brush with metal inclusions is between 1.15 and 1.30 g/cm$^3$, in particular between 1.2 and 1.28 g/cm$^3$. It has been found that an extremely constant friction coefficient with the aforementioned advantages can be realized with this density.

The object is further attained with a carbon brush with metal inclusions having the features recited in claim 7 Because the carbon brush with metal inclusions for a sliding contact element, which is in contact with a grounding ring of an electrical machine in a wind turbine, has a bulk density from 1 to 1.4 g/cm$^3$, preferably 1.15 to 1.30 g/cm$^3$, in particular from 1.2 to 1.28 g/cm$^3$, existing devices for discharging ground currents in wind turbines can advantageously be equipped with the carbon brush with metal inclusions according to the invention. As a result, the static service life of the bearings of the electric machine is markedly increased. Maintenance intervals and the rigging associated therewith can be significantly reduced.

Additional preferred embodiments of the invention are derived from the other features recited in the dependent claims.

The invention will now be explained in more detail in an exemplary embodiment with reference to the accompanying drawing, which shows schematically a device for discharging ground currents.

FIG. 1 shows a device for discharging ground currents, generally designated with 10. The device 10 includes a grounding ring 12 which is mounted on a shaft 14. The shaft 14 is part of a rotor of an electric machine, in particular of a rotor-fed asynchronous generator for wind turbines.

Design and operation of rotor-fed asynchronous generators are generally known, so that a detailed description thereof can be omitted in the context of the present disclosure.

A sliding contact element 16 having a carbon brush with metal inclusions 18 is associated with the grounding ring 12. The carbon brush with metal inclusions 18 is connected to ground potential via an illustrated line 20.

The carbon brush with metal inclusions 18 is in contact with the grounding ring 12. Such an arrangement is known in the art.

According to the invention, the carbon brush with metal inclusions 18 has a bulk density from 1.2 to 1.28 g/cm$^3$. Furthermore, the metal-graphite brush 18 is impregnated with a silver proportion between 2.5 and 5%.

Due to the low density and the proportion of silver, a low voltage drop, i.e. a low contact resistance between the carbon brush with metal inclusions 18 and the ground ring 12, is achieved in addition to the constant coefficient of friction.

To achieve the silver impregnation, a silver solution is injected into the carbon brush with metal inclusions 18 with the low bulk density, whereafter the silver is precipitated by a chemical-thermal process. The silver is hereby not melted. The proportion of silver plays only a minor role for the electrical conductivity of the carbon brush with metal inclusions 18. A silver proportion of 5% in the metal-graphite brush 18 lowers the voltage drop across the device 10 by 50%, whereas a silver proportion of 2.5% lowers the voltage drop in the device 10 by 25% compared to a carbon brush with metal inclusions that is not impregnated with silver.

The silver impregnation thus provides further advantages in addition to the low bulk density of the carbon brush with metal inclusions 18 already provided by the invention.

In particular, a high pulse current strength is achieved, which is this example 0 A/cm$^2$ at open circuit, and 20 A/cm$^2$ under load. Due to the low density, the carbon brush with metal inclusions 18 has high elasticity, resulting in a constant friction coefficient. The low density can be achieved, for example, by low ash content, such as 0.8% in the employed carbon brush with metal inclusions.

In summary, it can be stated that a stable coefficient of friction in combination with the low silver content in the brush material and a low voltage drop is achieved as a result of the highly elastic brush material for the carbon brush with metal inclusions 18 with low density. This enables a low-maintenance operational behavior of the device for discharging ground currents with low wear of the carbon brush with metal inclusions 18 and low wear of the grounding ring 12.

LIST OF REFERENCE NUMBERS

10 device
12 grounding ring
14 shaft
16 sliding contact element
18 carbon brush with metal inclusions
20 line

The invention claimed is:

1. A device for discharging ground currents, particularly in wind turbines, from electric machines with a grounding ring arranged on a rotor of the electric machine and with a sliding contact element connected to ground and in contact with the grounding ring, wherein the sliding contact element comprises a carbon brush having a bulk density from 1.2 to 1.28 g/cm$^3$, and the carbon brush comprises metal inclusions of silver, wherein the silver proportion is between 2 and 5%.

2. A carbon brush with metal inclusions for a sliding contact element which can be brought in contact with a grounding ring of an electric machine in a wind power plant, wherein the carbon brush has a bulk density from 1.2 to 1.28 g/cm$^3$, and a silver proportion between 2 and 5%.

* * * * *